US008166684B2

(12) United States Patent
Bains et al.

(10) Patent No.: US 8,166,684 B2
(45) Date of Patent: May 1, 2012

(54) DISPLAY BOARDS

(75) Inventors: Gurdip Singh Bains, Oadby (GB); Peter John Banks, Leicester (GB)

(73) Assignee: Three G Metal Fabrications Ltd., Leicester (GB)

( * ) Notice: Subject to any disclaimer, the term of this patent is extended or adjusted under 35 U.S.C. 154(b) by 438 days.

(21) Appl. No.: 12/225,646

(22) PCT Filed: Mar. 23, 2007

(86) PCT No.: PCT/GB2007/001087

§ 371 (c)(1), (2), (4) Date: May 21, 2009

(87) PCT Pub. No.: WO2007/113482

PCT Pub. Date: Oct. 11, 2007

(65) Prior Publication Data

US 2010/0281723 A1 Nov. 11, 2010

(30) Foreign Application Priority Data

Mar. 31, 2006 (GB) ..... 0606486.9

(51) Int. Cl.
*G09F 21/02* (2006.01)

(52) U.S. Cl. ..... 40/124.11; 40/606.01

(58) Field of Classification Search ..... 40/124.11; 135/900, 128

See application file for complete search history.

(56) References Cited

U.S. PATENT DOCUMENTS

| | | | | |
|---|---|---|---|---|
| 3,740,881 | A * | 6/1973 | Finger | 40/609 |
| 4,258,892 | A * | 3/1981 | Craine | 248/220.41 |
| 4,516,344 | A | 5/1985 | Seely | |
| 4,890,402 | A * | 1/1990 | Carroll | 40/124.06 |
| 5,102,171 | A * | 4/1992 | Saetre | 283/117 |
| D431,938 | S * | 10/2000 | Lewis | D6/480 |
| 6,330,889 | B1 * | 12/2001 | Overton | 135/95 |
| 7,021,666 | B2 * | 4/2006 | Hare | 283/117 |
| D556,823 | S * | 12/2007 | Lombard | D19/6 |
| 2004/0060211 | A1 * | 4/2004 | Thomas et al. | 40/124.11 |
| 2004/0244670 | A1 | 12/2004 | Young et al. | |
| 2008/0173702 | A1 * | 7/2008 | Meister | 229/78.2 |

FOREIGN PATENT DOCUMENTS

| | | |
|---|---|---|
| DE | 41 39 279 A1 | 6/1993 |
| DE | 42 27 069 A1 | 2/1994 |

OTHER PUBLICATIONS

Place Cards, http://www.flickr.com/photos/riversidefarmweddings/2702249255/. Photo taken on Oct. 7, 2007 and uploaded Jul. 25, 2008.*

The Bride's Place Cards; picture taked Jun. 4, 2004, http://www.flickr.com/photos/faerieenigma/452822154/.*

International Search Report dated Jun. 18, 2007, from PCT Application No. PCT/GB2007/001087.

Written Opinion of International Searching Authority dated Jun. 18, 2007, from PCT Application No. PCT/GB2007/001087.

* cited by examiner

*Primary Examiner* — Casandra Davis

(74) *Attorney, Agent, or Firm* — Kilyk & Bowersox, P.L.L.C.

(57) ABSTRACT

The present invention provides a display board comprising two flexible planar members joined together along an upper edge. The planar members are extendable between a first position for transport and storage where their lower edges are adjacent and a second position where their lower edges are spaced apart and the flexible planar members are curved. The display board can be used to display posters and other printed matter. It is lightweight and very stable even in the presence of strong winds.

13 Claims, 2 Drawing Sheets

DISPLAY BOARDS

CROSS-REFERENCE TO RELATED APPLICATIONS

The present application is a U.S. National Stage filing derived from PCT/GB2007/001087, filed Mar. 23, 2007, which claims a priority benefit from earlier filed GB Application No. 0606486.9 filed Mar. 31, 2006, which are incorporated herein in their entireties by reference.

TECHNICAL FIELD

The present invention relates to display boards, and more particularly to boards that can be used to display text, graphical information and printed matter such as posters, publicity information, news sheets, flyers, notices and advertisements, for example.

BACKGROUND ART

It is known to use display boards to display printed matter. However, most suffer from the serious disadvantage that they are made of rigid materials so that if they are used outside then they tend to be easily blown over. One example of a conventional display board is a so-called "sandwich board" or "A board" that consists of two rigid planar members that are joined together at their upper edges by a mechanical or integral hinge. The lower edges of the planar members may rest directly on the ground or can be provided with individual legs. Some form of restraining means is provided to keep the lower edges or the legs a certain distance apart during use. When viewed from the side the display board therefore takes on an "A" shape during use. To store and transport the display board the lower edges or legs of the planar members can be brought together to flatten or collapse the display board. Such "sandwich boards" and "A boards" are known to be particularly unstable and are easily blow over by moderate winds when used outside.

The problem can be addressed by providing the display board with a very heavy base. For example, the display board can include a heavy concrete or sand- or rubble-filled base to which a frame is mounted. A planar member for displaying the printed matter or text may then be fixedly secured to the frame, rotatably secured to the frame, or suspended from the frame in such a way that the planar member can swing freely. Although the heavy base improves the stability of the display board, the additional weight can cause problems of its own if the display board needs to be moved on a regular basis. For example, in the case of a display board that is placed on the pavement outside a retail outlet or shop then it may have to be moved inside every night and moved outside every morning. This is not easy if the base is very heavy.

An alternative in some cases where the display board is usually left outside is to secure it to a fixed object such as a lamp post, sign post, telegraph pole, bench, tree or the like. However, this limits the possible locations where the display board can be used and means that the display board must be provided with means to enable it to be properly secured.

There is therefore a need for a simple free-standing display board that is versatile, lightweight and easy to store and transport and which can be used in any outside location without being easily blown over.

SUMMARY OF THE INVENTION

The present invention provides a display board comprising two flexible planar members joined together along an upper edge, each planar member having a free lower edge that remains unconnected to any other part of the display board and is in contact with a supporting surface when the display board is in use, and wherein the planar members are extendable between a first position for storage and transportation where their lower edges are adjacent and a second position for use where their lower edges are spaced apart and the planar members are curved.

When the display board is in the second position, the lower edges of the flexible planar members will usually be placed in contact with a substantially flat supporting surface such as a pavement or floor, for example. Because the planar members are flexible, they will bend and flex in the presence of strong winds and the display board is very stable and will not topple over or be displaced. The display board of the present invention provides a new technical effect because, unlike a conventional "sandwich board" or "A board" that is made of rigid materials, the planar members that form the sides of the display board are flexible. The flexible characteristics of the planar members mean that the display board is able to bend and sway in the presence of strong winds rather than being blown over. A useful parallel might be made between trees that are free to bend and flex and fence panels that are fixed in position and cannot. The latter are much more likely to be damaged or blown over by a strong wind than the former because they cannot move to absorb the forces that are exerted on it by the wind. The display board of the present invention is designed to benefit from the flexibility of the planar members in the same way as a tree benefits from the flexibility of its trunk and branches to stay rooted in the ground. The conventional "sandwich board" or "A board" is rigid and is therefore much more likely to be blown over in the same way as a fence panel. The ability of the planar members to bend is combined with the fact that they naturally adopt a curved shape that is inherently stable and provides the display board with a lower centre of gravity when the lower edges are spaced apart in use. The display board of the present invention therefore exhibits a significant improvement in overall stability when compared to a conventional "sandwich board" or "A board". The display board of the present invention is also lightweight and is much easier to transport than a conventional display board having a heavy base.

To provide additional stability in very strong and gusting winds then non-slip members or strips can be located at the lower edge of each planar member to provide a better friction grip with the supporting surface. The non-slip members can be made of any suitable material such as a rubber-based or plastics material, for example.

The display board preferably includes a cross member (optionally tubular and of circular cross section) located at the joined upper edges of the planar members. The upper edges of the planar members can be welded, riveted or otherwise secured to the cross member. The cross member can be weighted to provide additional stability to the display board.

If an aperture or opening is provided in the planar members immediately below the cross member then this facilitates easy transport of the display board because a user can use the part of the cross member that is directly above (or adjacent to) the aperture as a carrying handle.

Although the planar members will naturally revert to, and remain in, the flattened of collapsed first position with their lower edges adjacent when the display board is lifted away from the supporting surface, it is generally preferred that the planar members can be releasably secured together in the first position so that their lower edges remain together during storage and transportation. Therefore, the display board preferably includes some sort of locking means for releasably securing the planar members in the first position. The locking means can include "hook and loop" fasteners, magnetic fasteners or mechanical fasteners such as clips or catches, for example. The locking means will normally be located on the inner surfaces of the planar members.

The planar members can be made of any material that is sufficiently rigid and durable to allow the display board to stand up during use, to flex to a curve and enable the display board to bend and flex in response to a prevailing wind. In fact, the applicant has discovered that the thickness of the planar members (and hence the amount by which they flex) is absolutely critical to the practical implementation of the present invention. A particularly suitable material would be a sheet of galvanised steel having a thickness of between 0.5 and 1.5 mm, and most preferably about 0.7 mm, but a plastics material such as acrylic sheeting can also be used.

Text and graphical information can be applied directly to the outer surface of one or both of the planar members by any suitable technique such as printing, etching, stamping or machining for example. The planar member can also be made from a suitable material or covered with a suitable paint, layer or coating to allow text and graphical information to be written directly on the display board using chalk or marker pens. In the case where the display board is used to display an item of printed material such as a poster, flyer or news sheet for example, then the item can be adhered directly to the outer surface of one of the planar members using a suitable (optionally a peelable or non-permanent) adhesive. In some cases it may not be appropriate to adhere the item directly to the display board and at least one of the planar members may therefore include means for releasably retaining an item to be displayed. A variety of different means can be provided. For example, at least one of the planar members could include openings, tabs or clips into which the edges of the item or a frame or mount for holding the item can be inserted. Fastening means can also be provided on a surface of at least one of the planar members to cooperate with corresponding fastening means provided directly on the item or provided on a frame or mount for holding the item.

In a preferred aspect of the present invention, the means for retaining the item to be displayed comprises a planar cover joined to an outer surface of one of the planar members such that the item to be displayed can be releasably retained between the planar cover and the planar member. A lower edge of the planar cover can be fixedly secured to the planar member, optionally by riveting it to a strip of metal such as stainless steel, for example. An upper edge of the planar cover can then be releasably secured to the planar member or simply allowed to rest against the curved surface of the planar member. The upper edge of the planar cover can be pulled away from the surface of the planar member, the item to be displayed can be inserted behind the planar cover and the upper edge of the planar cover can be releasably secured to the planar member to retain the item to be displayed in position. The means for releasably securing the upper edge of the planar cover to the planar member can include "hook and loop" fasteners, magnetic fasteners such as a magnetic strip, or mechanical fasteners such as press-fastenings, clips or catches, for example. The planar cover may also be secured to the planar member around a portion of its periphery to define a pocket or envelope between the planar cover and the planar member into which an item to be displayed can be inserted.

The planar cover will usually be substantially transparent (or at the very least translucent) so that the item to be displayed is visible behind it. The planar cover should also be flexible to conform to the curve of the adjacent planar member and is therefore preferably made of a clear plastics sheet material such as acrylic or polyethylene terephthalate (PET).

It is generally preferred that the weight of each planar member is substantially the same so that the display board as a whole remains reasonably balanced. Therefore, if only one of the planar members includes a planar cover whose lower edge is riveted to a strip of metal then a further strip of metal or some other material of similar weight is preferably secured to the lower edge of the other planar member. In some cases the overall stability of the display board can be improved by securing a strip of metal or some other relatively heavy material at the lower edge of both of the planar members.

For additional security, the display board may include means to enable a chain, rope or the like to be secured to the display board so that it can be attached to a fixed object. This could be as simple as providing an additional aperture or opening in one of the planar members so that a chain can be passed through it before being secured to or around the fixed object. However, providing an aperture or opening directly in one of the planar members may interfere with the item to be displayed and so it would also be possible for the display board to include a tab, loop or bracket that is integrally formed with, or fixedly secured to, one of the planar members and which includes an aperture or opening for receiving a chain.

DRAWINGS

With reference to FIGS. 1 to 4, a display board is made up of two flexible planar members 2 and 4 of 0.7 mm thick galvanised steel sheeting that are welded to each other and to a tubular member 6 along their upper edges 2*a* and 4*a*.

Lengths of a rubber-based non-slip material 8 are secured along the lower edges 2*b* and 4*b* of the planar members 2 and 4 to provide a good friction grip with the ground G on which the display board is standing. Magnetic fixings 10 are provided on the inner surfaces of the planar members 2 and 4. When the display board is lifted off the ground G, the natural resilience in the planar members 2 and 4 will cause the display board to adopt the flattened or collapsed position shown in FIG. 2 that is suitable for storage and transportation and where the lower edges 2*b* and 4*b* of the planar members are adjacent one another. The magnetic fixings 10 (one being a north pole and the other being a south pole) come into contact with each other and the magnetic attraction keeps the planar members 2 and 4 together in the flattened or collapsed position.

Figure 1:
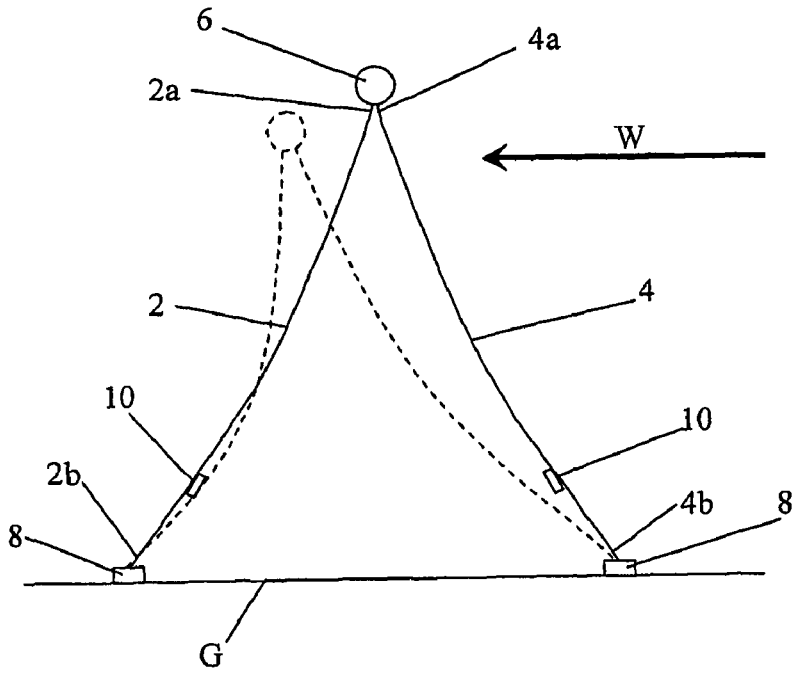
FIG. 1 is a side view of a first display board according to the present invention in an open position for use.
Figure 4:
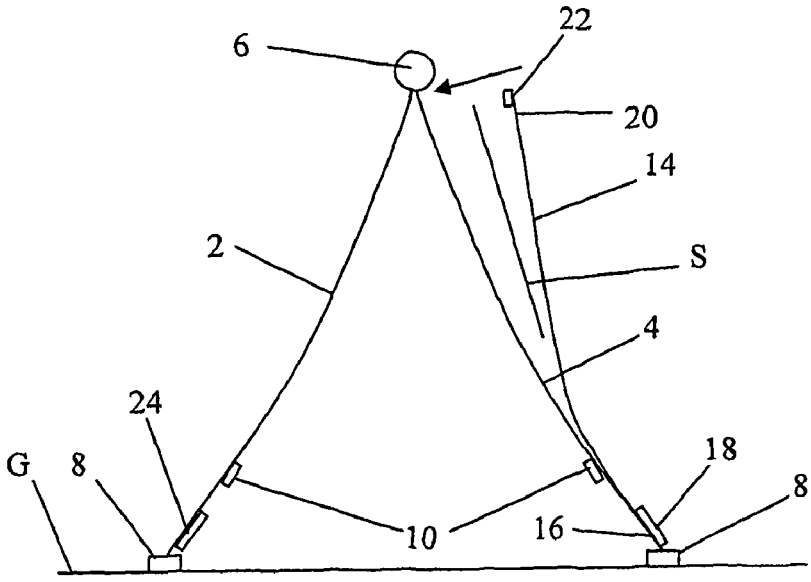
FIG. 4 is a side view of the display board of FIG. 3 showing the insertion of a sheet of printed material behind a planar cover.

To erect the display board, it is simply a matter of pulling the planar member 2 and 4 apart against the magnetic attraction of the magnetic fixings 10 and placing the display board on the ground G with the lower edges 2*b* and 4*b* of the planar members spaced apart such that the planar members adopt the curved arrangement shown clearly in FIGS. 1 and 4.

An aperture 12 (FIG. 3) is provided in the planar members 2 and 4 underneath the tubular member 6, which functions as a carrying handle for transporting the display board.

If a prevailing wind (represented by the arrow W in FIG. 1) blows against the display board then the planar members 2 and 4 can bend and flex in the prevailing direction as shown by the ghosted drawing of the display board. The display board of the present invention is therefore very stable and it is difficult to blow it over. It is also important to note that this stability is achieved in a display board that is both lightweight and easy to store and transport.

Figure 2:
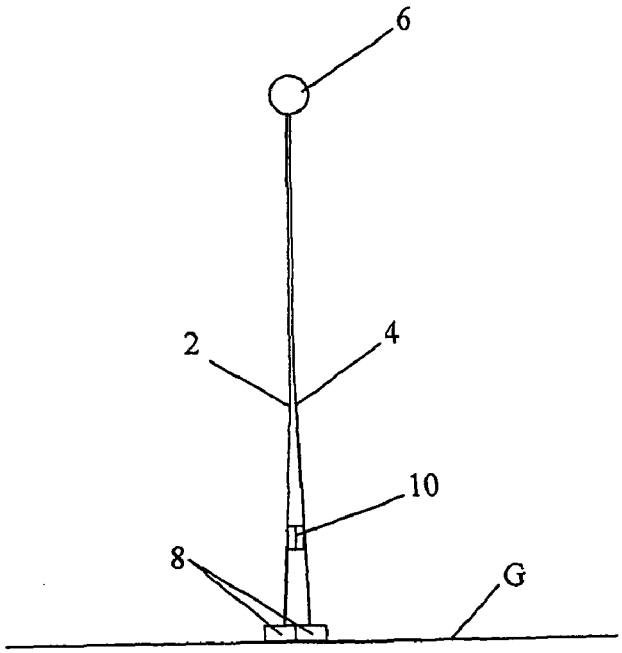
FIG. 2 is a side view of the display board of FIG. 1 in a closed position for storage and transportation.

The planar members of the first display board shown in FIGS. 1 and 2 are coated with so-called "blackboard" paint so that text and graphical information can be applied directly to the display board using chalk.

Figure 3:
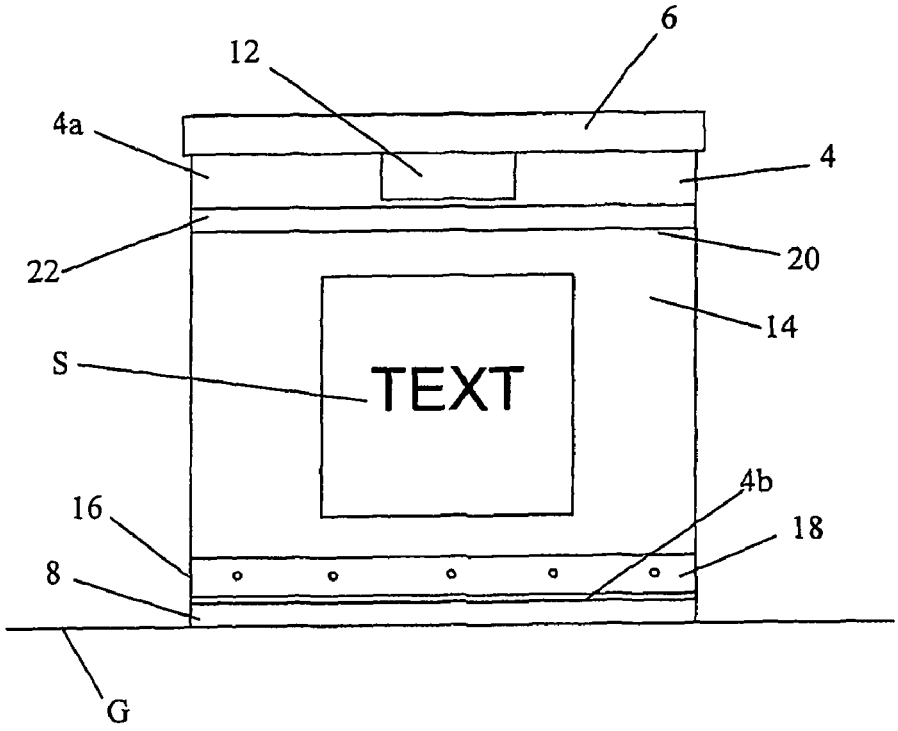
FIG. 3 is a front view of a second display board according to the present invention.

The second display board shown in FIGS. 3 and 4 includes a planar cover 14 for holding a sheet S of printed material such as a poster. The planar cover 14 has a lower edge 16 that is riveted to a strip 18 of stainless steel that is secured at the lower edge 4*b* of the planar member 4. The planar cover 14 is made of PET and is flexible so that it can bend and flex with the underlying planar member 4. The planar cover 14 can be bent back away from the planar member 4 as shown in FIG. 4 to allow the sheet S to be placed between the planar cover and the planar member. The upper edge 20 of the planar cover 14 can be releasably secured to the outer surface of the planar member 4 using a magnetic strip 22 that is attracted to the galvanised steel planar member to retain the sheet S in position. Even without the magnetic strip 22 the sheet S should not be free to move because it is trapped in a friction fit between the curved planar member 4 and the curved planar cover 14. An identical planar cover (not shown) can also be secured to the other planar member 2.

To balance the display board of FIG. 4, the other planar member 2 includes a strip of metal 24 secured to its inner surface at its lower edge 2*b*. The added weight of the stainless steel strip 18 and the metal strip 24 help to prevent the display board from being blown over.

In some cases the planar cover 14 can be dispensed with and the sheet S can be adhered directly to the outer surface of the planar member 4 using an adhesive.

The invention claimed is:

1. A display board comprising two flexible members joined together along an upper edge, each flexible member having a free lower edge that remains unconnected to any other part of the display board and is in contact with a supporting surface when the display board is in use, and a non-slip member located at the lower edge of each flexible member, wherein the flexible members are extendable between a first position for storage and transportation where their lower edges are adjacent and the flexible members are planar, and a second position for use, wherein, in the second position, the lower edges are spaced apart by a first distance, each of the flexible members are curved, and the display board is configured such that both flexible members change their curvatures under windy conditions while the lower edges remain spaced apart by the first distance.

2. A display board according to claim 1, wherein at least one of the flexible members includes means for releasably retaining an item to be displayed.

3. A display board according to claim 2, wherein the means for retaining the item to be displayed comprises a planar cover joined to one of the flexible members such that the item to be displayed can be retained between the planar cover and the respective flexible member.

4. A display board according to claim 3, wherein a lower edge of the planar cover is fixedly secured to the respective flexible member.

5. A display board according to claim 3, wherein an upper edge of the planar cover is releasably secured to the respective flexible member.

6. A display board according to claim 5, wherein the upper edge of the planar cover is releasably secured to the respective flexible member by a magnetic strip.

7. A display board according to claim 3, wherein the planar cover is substantially transparent.

8. A display board according to claim 1, wherein at least one of the flexible members has a weight secured at its lower edge.

9. A display board according to claim 8, wherein the weight is a metal strip.

10. A display board according to claim 1, further comprising locking means for releasably securing the flexible members in the first position.

11. A display board comprising two flexible members joined together along an upper edge of each, a cross member located at the joined upper edges of the flexible members, and an aperture in the flexible members immediately below the cross member, each planar member having a free lower edge that remains unconnected to any other part of the display board and is in contact with a supporting surface when the display board is in use, and wherein the flexible members are extendable between a first position for storage and transportation where their lower edges are adjacent and the flexible members are planar, and a second position for use where their lower edges are spaced apart and the flexible members are curved.

12. A display board comprising two flexible members joined together along an upper edge, each flexible member having a free lower edge that remains unconnected to any other part of the display board and is in contact with a supporting surface when the display board is in use, each flexible member comprising a metal sheet having a thickness of between 0.5 mm and 1.5 mm, wherein the flexible members are extendable between a first position for storage and transportation where their lower edges are adjacent and the flexible members are planar, and a second position for use where their lower edges are spaced apart and the flexible members are curved.

13. A display board according to claim 12, wherein the flexible members are formed of metal sheet having a thickness of about 0.7 mm.

* * * * *